US007442116B2

(12) United States Patent
Miyauchi et al.

(10) Patent No.: US 7,442,116 B2
(45) Date of Patent: Oct. 28, 2008

(54) CHEMICAL MECHANICAL POLISHING PAD

(75) Inventors: Hiroyuki Miyauchi, Chuo-ku (JP); Hiroshi Shiho, Chuo-ku (JP); Nobuo Kawahashi, Chuo-ku (JP)

(73) Assignee: JSR Corporation, Tokyo (JP)

( * ) Notice: Subject to any disclaimer, the term of this patent is extended or adjusted under 35 U.S.C. 154(b) by 0 days.

(21) Appl. No.: 10/978,472

(22) Filed: Nov. 2, 2004

(65) Prior Publication Data

US 2005/0113011 A1 May 26, 2005

(30) Foreign Application Priority Data

Nov. 4, 2003 (JP) ..... 2003-374855

(51) Int. Cl.
*B24D 11/00* (2006.01)

(52) U.S. Cl. ..... 451/526; 451/921

(58) Field of Classification Search ..... 451/6, 451/921, 527–530, 523, 288, 526; 438/692, 438/693; 15/230, 230.17, 19; 428/156, 167, 428/172; 264/328.16
See application file for complete search history.

(56) References Cited

U.S. PATENT DOCUMENTS

| | | | | |
|---|---|---|---|---|
| 6,217,426 | B1 * | 4/2001 | Tolles et al. | 451/285 |
| 6,387,312 | B1 * | 5/2002 | Roberts et al. | 264/328.16 |
| 6,605,333 | B2 * | 8/2003 | Ferreira et al. | 428/95 |
| 6,656,019 | B1 * | 12/2003 | Chen et al. | 451/41 |
| 6,699,104 | B1 * | 3/2004 | Baker et al. | 451/28 |
| 2004/0259479 | A1 * | 12/2004 | Sevilla | 451/41 |
| 2005/0095957 | A1 * | 5/2005 | Khoury | 451/41 |

FOREIGN PATENT DOCUMENTS

| | | |
|---|---|---|
| JP | 8-500622 | 1/1996 |
| JP | 8-39423 | 2/1996 |
| JP | 8-216029 | 8/1996 |
| JP | 11-70463 | 3/1999 |
| JP | 2000-33552 | 2/2000 |
| JP | 2000-34416 | 2/2000 |
| JP | 2001-18165 | 1/2001 |
| JP | 2001-334455 | 12/2001 |
| JP | 2002-36097 | 2/2002 |
| WO | WO 94/04599 | 3/1994 |

* cited by examiner

*Primary Examiner*—Jacob K Ackun, Jr.
(74) *Attorney, Agent, or Firm*—Oblon, Spivak, McClelland, Maier & Neustadt, P.C.

(57) ABSTRACT

A chemical mechanical polishing pad having a face for polishing an object to be polished, a non-polishing face opposite to the face and a side face for interconnecting these faces and including the pattern of recessed portions which are formed on the non-polishing face and are open to the non-polishing face but not on the side face.

8 Claims, 4 Drawing Sheets

CHEMICAL MECHANICAL POLISHING PAD

FIELD OF THE INVENTION

The present invention relates to a chemical mechanical polishing pad.

DESCRIPTION OF THE PRIOR ART

In the manufacture of a semiconductor device, CMP (Chemical Mechanical Polishing) has been attracting much attention as a polishing technique capable of providing an extremely flat surface to a silicon substrate or a silicon substrate having wires, electrodes, etc. formed thereon (to be referred to as "semiconductor wafer" hereinafter). CMP is a technique for polishing the surface by letting an aqueous dispersion for chemical mechanical polishing (aqueous dispersion of abrasive grains) flow down the surface of a chemical mechanical polishing pad while the pad and the surface to be polished are brought into slide contact with each other. It is known that the polishing result is greatly affected by the shape and properties of the chemical mechanical polishing pad in this CMP. Therefore, various chemical mechanical polishing pads have been proposed up till now.

CMP has been carried out by using a polyurethane foam having pores as a chemical mechanical polishing pad and holding an aqueous dispersion for chemical mechanical polishing in the pores open to the surface of this pad as disclosed by JP-A 11-70463, JP-A 8-216029 and JP-A 8-39423 (the term "JP-A" as used herein means an "unexamined published Japanese patent application").

A polishing pad comprising a water-soluble polymer dispersed in a matrix resin has recently been proposed as a polishing pad capable of forming pores without using a foam (JP-A 8-500622, JP-A 2000-34416, JP-A 2000-33552 and JP-A 2001-334455). This technology is used to form pores by dissolving the water-soluble polymer dispersed in the matrix resin of the polishing pad in CMP slurry or water during polishing.

It is known that the polishing rate and the surface state of the object to be polished can be improved by forming grooves on the surface (polishing side) of the chemical mechanical polishing pad.

However, when the surface is to be polished by chemical mechanical polishing, abrasive grains contained in the aqueous dispersion for chemical mechanical polishing in use may be agglomerated into a coarse particle, or cutting chips may remain on the polishing surface after grooves are formed on the surface by cutting. The coarse particle or cutting chips may act as foreign matter in chemical mechanical polishing to produce a scratch defect on the polished surface. It is therefore desired to improve this.

To solve the above problem, JP-A 2002-36097 proposes a multi-layered pad comprising a soft buffer layer on the rear surface (non-polishing side) of the pad. However, the multi-layered pad improves the above problem to a certain extent but is not a drastic solution. It is known that the production process thereof is complicated, thereby causing a cost increase and a quality control problem.

To solve the above problems, JP-A 2001-18165 discloses a technology for forming grooves which are not closed or sealed at a side surface on the rear surface (non-polishing side) of a chemical mechanical polishing pad.

Although this technology suppresses the production of the above scratch, the polished surface may be inferior in surface flatness. Therefore, it is desired to improve this.

SUMMARY OF THE INVENTION

It is an object of the present invention which has been made to solve the above problems of the prior art to provide a chemical mechanical polishing pad which can prevent the surface to be polished from being scratched in the chemical mechanical polishing step and can provide a polished surface having excellent flatness.

Other objects and advantages of the present invention will become apparent from the following description.

According to the present invention, the above objects and advantages of the present invention are attained by a chemical mechanical polishing pad having a face for polishing an object to be polished, a non-polishing face opposite to the face and a side face for interconnecting these faces and including the pattern of recessed portions which are formed on the non-polishing face and are open to the non-polishing face and not to the side face.

DETAILED DESCRIPTION OF THE PREFERRED EMBODIMENTS

Figure 1:
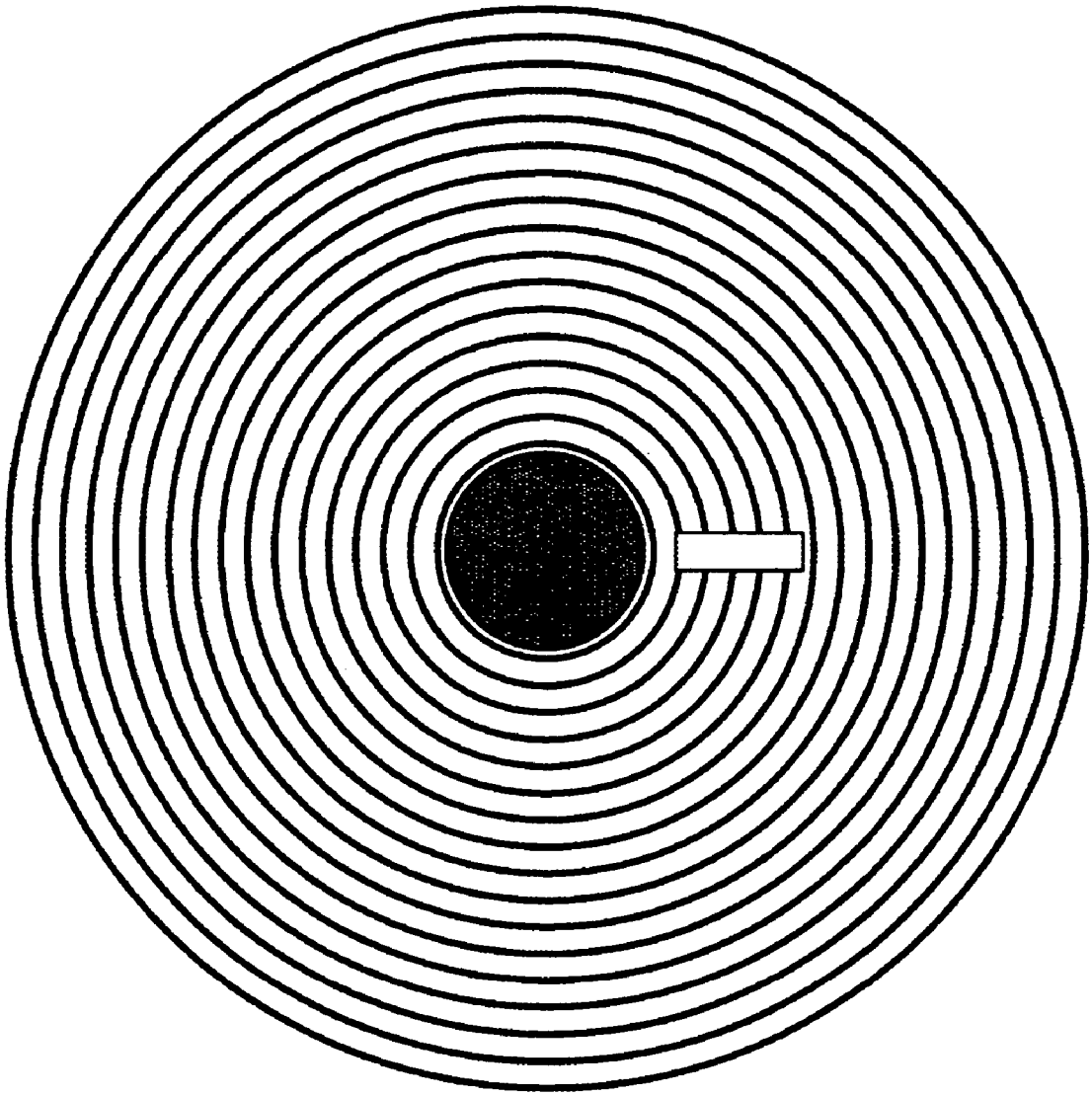
FIG. 1 is a schematic diagram of the recessed portions of the rear surface of a chemical mechanical polishing pad manufactured in Example 1.

The chemical mechanical polishing pad of the present invention has patterned recessed portions (to be referred to as "pattern of the recessed portions" hereinafter) which are not open to the side face of the pad on the non-polishing face. The patterned recessed portions have the function of forming a closed space between the chemical mechanical polishing pad and the platen of a chemical mechanical polishing machine in the chemical mechanical polishing step. Even when foreign matter such as a coarse particle or the cutting chips of the pad contained in the aqueous dispersion for chemical mechanical polishing enters the space between the chemical mechanical polishing pad and the object to be polished, excessive pressure which is generated locally can be scattered by this closed space, thereby suppressing scratching. As the space is closed, the chemical mechanical polishing pad can retain a certain measure of elasticity while it is set in the chemical mechanical polishing machine, thereby obtaining the flatness of the polished surface.

The above expression "patterned recessed portions" means that the recessed portions form an almost regular or almost uniform pattern.

The shape of each of recessed portions forming such a pattern on the non-polishing face is not particularly limited and may be circular, elliptic, polygonal or groove-like.

When the recessed portions are circular, elliptic or polygonal and are located at respective intersecting points of a lattice pattern or triangular lattice pattern or at respective apices of a honeycomb pattern, they can form patterned recessed portions. When the recessed portions are circular, the diameter thereof is preferably 0.1 to 50 mm, more preferably 0.1 to 10 mm, and particularly preferably 0.5 to 10 mm. When the recessed portions are elliptic or polygonal, the long diameter thereof is preferably 0.1 to 50 mm, more preferably 0.1 to 10 mm, and particularly preferably 0.5 to 10 mm. When the recessed portions are circular, elliptic or polygonal, the total area of the patterned recessed portions is preferably 5 to 80 %, more preferably 10 to 67 %, particularly preferably 10 to 50 % of the area of the non-polishing face.

When the recessed portions are grooves, they may be spiral grooves, grooves arranged concentric to one another, or grooves arranged in a lattice or radically, thereby forming patterned recessed portions. When the recessed portions are grooves, the width thereof is preferably 0.1 to 20 mm, more preferably 0.1 to 10 mm. When the patterned recessed portions are spiral grooves, grooves arranged concentric to one another or grooves arranged in a lattice, the pitch thereof is preferably 0.1 to 200 mm, more preferably 0.2 to 100 mm and particularly preferably 1 to 50 mm. When the patterned recessed portions are grooves arranged radically, the angle between adjacent grooves is preferably 1 to 120°0, more preferably 5 to 90°, particularly preferably 5 to 60°.

In all of the above cases, the depth of the recessed portions is preferably 0.01 to 2.0 mm, more preferably 0.1 to 1.5 mm, particularly preferably 0.1 to 1.0 mm.

The sectional form of the recessed portions is not particularly limited but preferably rectangular, trapezoidal (either upper side or bottom side may be larger than the other), U-shaped or V-shaped.

The patterned recessed portions formed on the non-polishing face of the chemical mechanical polishing pad of the present invention are not open to the side face of the pad. The shortest distance between the end of the patterned recessed portions and the side face of the pad is preferably 0.5 mm or more, more preferably 0.5 to 100 mm and particularly preferably 1.0 to 50mm.

The shape of the chemical mechanical polishing pad of the present invention is not particularly limited and may be disk-like or polygonal pillar-like. It may be suitably selected according to the polishing machine to be used with the chemical mechanical polishing pad of the present invention.

The size of the chemical mechanical polishing pad is not particularly limited. However, when the chemical mechanical polishing pad is shaped like a disk, the diameter thereof is preferably 150 to 1,200 mm, particularly preferably 500 to 800 mm and the thickness thereof is preferably 1.0 to 5.0 mm, and particularly preferably 1.5 to 3.0 mm.

The chemical mechanical polishing pad of the present invention may have grooves having any shape on the polishing face or other recessed portions as required. As for the shape of the grooves, they may be concentric grooves, lattice grooves, spiral grooves or radial grooves. As the other recessed portions, a large number of circular or polygonal recessed portions may be formed on the polishing face.

The chemical mechanical polishing pad of the present invention may further have a circular or polygonal recessed portion which does not form the above pattern at the center of the non-polishing face. This recessed portion exhibits the function of suppressing scratching together with the above patterned recessed portions.

The expression "at the center" means not only that the recessed portion is located at the center in a strictly mathematical sense but also that the center of the non-polishing face of the polishing pad is located within the area of the above recessed portion.

The recessed portion is particularly preferably circular. When the recessed portion is circular, the upper limit of diameter thereof is preferably 100 % or less, more preferably 75 % or less, and particularly preferably 50 % or less of the diameter of the object to be polished, for example, a wafer. When the recessed portion is circular, the lower limit of diameter thereof is preferably 1 mm, more preferably 5 mm regardless of the size of the object to be polished.

For example, when the diameter of a wafer as the object to be polished is 300 mm and the recessed portion is circular, the diameter of the recessed portion is preferably 1 to 300 mm, more preferably 1 to 225 mm, and particularly preferably 5 to 150 mm. When the diameter of the wafer as the object to be polished is 200 mm and the recessed portion is circular, the diameter of the recessed portion is preferably 1 to 200 mm, more preferably 1 to 150 mm, particularly preferably 5 to 100 mm.

The depth of the recessed portion is preferably 0.01 to 2.0 mm, more preferably 0.1 to 1.5 mm, particularly preferably 0.1 to 1.0 mm.

The chemical mechanical polishing pad of the present invention may have a light transmitting area which optically communicates from the polishing face to the non-polishing face. The pad having such a light transmitting area makes it possible to optically detect the end point of chemical mechanical polishing when it is set in a chemical mechanical polishing machine having an optical end-point detector. The expression "having light transmitting" as used herein does not always means that the pad transmits light completely but that the pad may transmit part of light for end-point detection from the optical end-point detector. For example, the transmittance of light having a wavelength between 100 and 3,000 nm, specifically between 400 and 800 nm is preferably 8 % or more, more preferably 10 % or more, and particularly preferably 12 % or more.

The above transmittance does not need to be higher than required. When it is 70% or less, specifically 65% or less, more specifically 60% or less, the object of the present invention can be attained.

For example, the transmittance of light having a wavelength of 633 nm is preferably 8 to 70%, more preferably 10 to 65%, particularly preferably 12 to 60%.

The position of the light transmitting area must correspond to the position of the optical end-point detector of the chemical mechanical polishing machine to be used with the chemical mechanical polishing pad of the present invention. The light transmitting area may be located at a position other than the center of the pad, for example, a position where the center of the light transmitting area or the center of gravity of the light transmitting area is preferably 50 to 400 mm, and particularly preferably 50 to 250 mm away from the center of the chemical mechanical polishing pad.

The plane shape of the light transmitting area is not particularly limited and may be circular, elliptic, fan-shaped (shape obtained by cutting out a circle or loop at a predetermined angle), polygonal (square, rectangular or trapezoidal) or annular.

The number of light transmitting areas of the chemical mechanical polishing pad is not particularly limited and may be one or more. The position of the light transmitting area is not particularly limited if it satisfies the above position relationship.

The above light transmitting area may be formed by any method. Preferably, part of the rear surface of the chemical mechanical polishing pad is made thin to form the above light transmitting area. The thin portion is a portion having a thickness smaller than the maximum thickness of the chemical mechanical pad. Preferably, the plane shape of this thin portion corresponds to the plane shape of the above light transmitting area. The sectional form of the thin portion may be, for example, polygonal (square or pentagonal), dome-like, etc.

The thickness of this thin portion is not particularly limited but the smallest thickness of the thin portion is preferably 0.1 to 3.0 mm, more preferably 0.3 to 3.0 mm. When the thickness of the thin portion is smaller than 0.1 mm, it is difficult to ensure sufficiently high mechanical strength for this portion.

The size of the thin portion is not particularly limited. When the thin portion is circular, the diameter thereof is preferably 5 to 100 mm, when it is annular, the width thereof is preferably 5 mm or more, and when it is rectangular or elliptic, the long diameter thereof is preferably 10 to 200 mm and the shorter diameter thereof is preferably 5 to 100mm.

When this thin portion is formed on the non-polishing rear surface of the chemical mechanical polishing pad as a light transmitting area, the pattern of the recessed portions on the rear surface which is the main feature of the present invention is destroyed in the area but the effect of the present invention is not cancelled thereby.

The chemical mechanical polishing pad of the present invention may be made of any material if it has the above feature and can serve as a chemical mechanical polishing pad. It is preferred that pores having the functions of holding slurry during chemical mechanical polishing and retaining polishing chips temporarily should be formed before polishing, out of the functions of a chemical mechanical polishing pad. Therefore, the chemical mechanical polishing pad is preferably made of a material comprising water-soluble particles and a water-insoluble portion in which the water-soluble particles are dispersed, or a material comprising cavities and a water-insoluble member in which the cavities are dispersed, for example, a foam.

Out of these, the former material can hold slurry in pores formed by contacting the water-soluble particles to the aqueous medium of slurry containing an aqueous medium and solid matter during polishing to dissolve or swell them in the medium and eliminating them. Meanwhile, the latter material can hold slurry in pores formed as the cavities in advance.

The material of the above "water-insoluble portion" is not particularly limited but is preferably an organic material because it is easily molded to have a predetermined shape and predetermined properties and can provide suitable hardness and suitable elasticity. Examples of the organic material include thermoplastic resins, elastomers, rubbers (crosslinked rubbers) and curable resins (resins cured by heat or light such as thermally curable resins or light curable resins). They may be used alone or in combination.

The above thermoplastic resins include 1,2-polybutadiene resin, polyolefin resins such as polyethylene, polystyrene resins, polycyclic resins such as (meth)acryl ate-based resins, vinyl ester resins (excluding acrylic resins), polyester resins, polyamide resins, Fluor resins such as polyvinylidene fluoride, polycarbonate resins and placental resins.

The above elastomers include dyne elastomers such as 1,2-polybutadiene, polyolefin elastomer (TPO), styrene-based elastomers such as styrene-butadiene-styrene block copolymer (SBS) and hydrogenated block copolymers thereof (SEBS), thermoplastic polyurethane elastomers (TPU), thermoplastic elastomers such as thermoplastic polyester elastomers (TPEE) and thermoplastic polyamide elastomers (TPAE), silicone resin elastomers and Fluor resin elastomers. The rubbers include conjugated dyne rubbers such as butadiene rubber (high cis-butadiene rubber, low cis-butadiene rubber, etc.), isoprene rubber, styrene-butadiene rubber and styrene-isoprene rubber, nitride rubbers such as acrylonitrile-butadiene rubber, acrylic rubber, ethylene-α-olefin rubbers such as ethylene-propylene rubber and ethylene-propylene-dyne (EPDM) rubber, and other rubbers such as butyl rubber, silicone rubber and fluorine rubber.

The above curable resins include urethane resins, epoxy resins, acrylic resins, unsaturated polyester resins, polyurethane-urea resins, urea resins, silicon resins, phenol resins and vinyl ester resins.

The above organic materials may be modified by an acid anhydride group, carboxyl group, hydroxyl group, epoxy group or amino group. The compatibility with the water-soluble particles to be described hereinafter and slurry of the organic material can be adjusted by modification.

These organic materials may be used alone or in combination of two or more.

Further, the organic material may be a partially or wholly crosslinked polymer or non-crosslinked polymer. Therefore, the water-insoluble portion may be composed of a crosslinked polymer alone, a mixture of a crosslinked polymer and a non-crosslinked polymer, or a non-crosslinked polymer alone. It is preferably a cross linked polymer alone or a mixture of a crosslinked polymer and a non-crosslinked polymer. When a crosslinked polymer is contained, elastic recovery force is provided to the water-insoluble portion and displacement caused by shear stress applied to the chemical mechanical polishing pad during polishing can be reduced. Further, it is possible to effectively prevent the pores from being elastically deformed by the excessive extension of the water-insoluble portion during polishing and dressing and the surface of the chemical mechanical polishing pad from being excessively napped. Therefore, the pores are formed efficiently even during dressing, whereby a reduction in the retain ability of the slurry during polishing can be suppressed and further the pad is rarely napped, thereby not impairing polishing flatness. The method of crosslinking the above material is not particularly limited. For example, chemical crosslinking making use of an organic peroxide, sulfur or sulfur compound or radiation crosslinking by applying an electron beam may be employed.

The crosslinked polymer may be a crosslinked rubber, curable resin, crosslinked thermosetting resin or crosslinked elastomer out of the above organic materials. Out of these, a crosslinked thermoplastic resin and/or crosslinked elastomer all of which are stable to a strong acid or strong alkali contained in many kinds of slurry and are rarely softened by water absorption are preferred. Out of the crosslinked thermoplastic resin and crosslinked elastomer, that which is crosslinked with an organic peroxide is more preferred and crosslinked 1 ,2-polybutadiene is particularly preferred.

The content of the crosslinked polymer is not particularly limited but preferably 30 vol % or more, more preferably 50 vol % or more, particularly preferably 70 vol % or more and may be 100 vol % of the water-insoluble portion. When the content of the crosslinked polymer in the water-insoluble portion is lower than 30 vol %, the effect obtained by containing the crosslinked polymer may not be fully obtained.

The residual elongation after breakage (to be simply referred to as "residual elongation at breakage"hereinafter) of the above water-insoluble portion containing a crosslinked polymer can be 100 % or less when a specimen of the above water-insoluble portion is broken at 80°C in accordance with JIS K 6251. The total distance between bench marks of the specimen after breakage becomes 2 times or less the distance between the bench marks before breakage. This residual elongation at breakage is preferably 30 % or less, more preferably 10 % or less, particularly preferably 5 % or less and generally 0 % or more. When the above residual elongation at breakage is higher than 100 %, fine pieces scraped off from the surface of the chemical mechanical polishing pad or stretched at the time of polishing and surface renewal tend to fill the pores disadvantageously. The "residual elongation at breakage"is an elongation obtained by subtracting the distance between bench marks before the test from the total distance between each bench mark and the broken portion of the broken and divided specimen in a tensile test in which a dumbbell-shaped specimen No. 3 is broken at a tensile rate of 500 mm/mm and a test temperature of 80°C in accordance with the "vulcanized rubber tensile test method"specified in JIS K 6251. The test is carried out at 80° C. as mentioned above because heat is generated by slide contact at the time of actual polishing.

The above "water-soluble particles" are particles which separate from the water-insoluble portion when they come into contact with slurry as an aqueous dispersion in the polishing pad. This separation occurs when they are dissolved in water contained in the slurry upon their contact with water or when they swell and gel by absorbing this water. Further, this dissolution or swelling is caused not only by their contact with water but also by their contact with an aqueous mixed medium containing an alcohol-based solvent such as methanol.

The water-soluble particles in the chemical mechanical polishing pad have the effect of increasing the indentation hardness of the pad in addition to the effect of forming pores. For example, the shore D hardness of the polishing pad of the present invention is set to preferably 35 or more, more preferably 50 to 90, and particularly preferably 60 to 85 and generally 100 or less by adding the water-soluble particles. When the shore D hardness is 35 or more, pressure applied to the object to be polished can be increased, and the polishing rate can be thereby improved. In addition, a high degree of polishing flatness is obtained. Therefore, the water-soluble particles are particularly preferably a solid substance which can ensure sufficiently high indentation hardness for the chemical mechanical polishing pad.

The material of the water-soluble particles is not particularly limited and may be, for example, organic water-soluble particles or inorganic water-soluble particles. Examples of the material for forming the organic water-soluble particles include saccharine (polysaccharides such as starch, dextrin and cyclodextrin, lactose, manifold, etc.), celluloses (such as hydroxypropyl cellulose, methyl cellulose, etc.), protein, polyvinyl alcohol, polyvinyl pyrrolidone, polycyclic acid, polyethylene oxide, water-soluble photosensitive resins, suffocated polyisoprene and suffocated polyisoprene copolymers. Examples of the material for forming the inorganic water-soluble particles include potassium acetate, potassium nitrate, potassium carbonate, potassium hydrogen carbonate, potassium chloride, potassium bromide, potassium phosphate and magnesium nitrate. These water-soluble particles may be used alone or in combination of two or more. The water-soluble particles may be made of a predetermined single material, or two or more different materials.

The water-soluble particles have an average particle diameter of preferably 0.1 to 500 μm, more preferably 0.5 to 100 μm. The pores are as big as preferably 0.1 to 500 μm, more preferably 0.5 to 100 μm. When the average particle diameter of the water-soluble particles is smaller than 0.1 μm, the formed pores become smaller in size than the abrasive grains in use, whereby a polishing pad capable of holding slurry completely is apt to be hardly obtained. When the average particle diameter is larger than 500 μm, the formed pores become too big, whereby the mechanical strength and polishing rate of the obtained polishing pad tend to lower.

The content of the water-soluble particles is preferably 10 to 90 vol %, more preferably 15 to 60 vol %, particularly preferably 20 to 40 vol % based on 100 vol % of the total of the water-insoluble matrix and the water-soluble particles. When the content of the water-soluble particles is lower than 10 vol %, pores are not fully formed in the obtained polishing pad and the polishing rate tends to lower. When the content of the water-soluble particles is higher than 90 vol %, it may be difficult to completely prevent the water-soluble particles existent in the interior of the obtained polishing pad from swelling or dissolving, thereby making it difficult to maintain the hardness and mechanical strength of the obtained polishing pad at appropriate values.

It is preferred that the water-soluble particles should dissolve in water only when they are exposed to the surface layer of the polishing pad and should not absorb moisture or swell when they are existent in the interior of the polishing pad. Therefore, the water-soluble particles may have an outer shell for suppressing moisture absorption on at least part of their outermost portion. This outer shell may be physically adsorbed to the water-soluble particle, chemically bonded to the water-soluble particle, or in contact with the water-soluble particle by physical adsorption and chemical bonding. The outer shell is made of epoxy resin, polyimide, polyamide or polysilicate. Even when it is formed on only part of the water-soluble particle, the above effect can be fully obtained.

The above water-insoluble matrix may contain a compatibilizing agent to control compatibility with the water-soluble particles and the dispensability of the water-soluble particles in the water-insoluble matrix. Examples of the compatibilizing agent include photopolymers, block copolymers and random copolymers modified by an acid anhydride group, carboxyl group, hydroxyl group, epoxy group, oxazoline group or amino group, nonionic surfactants and coupling agents.

The water-insoluble portion constituting the chemical mechanical polishing pad comprising the latter water-insoluble portion (foam, etc.) formed by dispersing cavities is made of polyurethane, melamine resin, polyester, polysulfide or polyvinyl acetate.

The average size of the cavities dispersed in the water-insoluble portion is preferably 0.1 to 500 μm, more preferably 0.5 to 100 μm.

Besides the above materials, the chemical mechanical polishing pad of the present invention may further contain an abrasive grain, oxidizing agent, alkali metal hydroxide, acid, pH modifier, surfactant and scratch preventing agent. Preferably, the abrasive grain and oxidizing agent out of these are not contained.

The process for producing the chemical mechanical polishing pad of the present invention is not particularly limited and the method of forming the recessed portions of the chemical mechanical polishing pad is not particularly limited as well. For instance, after a composition for chemical mechanical polishing pads which will become a chemical mechanical polishing pad is prepared and molded into a desired rough shape, recessed portions are formed by cutting this molded product. Or, the composition for chemical mechanical polishing pads is molded in a mold having a pattern for forming recessed portions to form recessed portions and the rough shape of a chemical mechanical polishing pad at the same time.

The process for obtaining the composition for chemical mechanical polishing pads is not particularly limited. The composition can be obtained by kneading together required materials including a predetermined organic material with a mixer. The mixer is a known device such as a roll, kneader, Banbury mixer or extruder (single-screw or multi-screw).

The composition for chemical mechanical polishing pads containing water-soluble particles for obtaining a chemical mechanical polishing pad containing water-soluble particles can be prepared by kneading together, for example, a water-insoluble portion, water-soluble particles and other additives. Advantageously, they are kneaded together under heating so that they can be easily processed at the time of kneading. The water-soluble particles are preferably solid at the kneading temperature. When they are solid, they can be dispersed with the above preferred average particle diameter irrespective of their compatibility with the water-insoluble portion.

Therefore, the type of the water-soluble particles is selected according to the processing temperature of the water-insoluble portion in use.

The chemical mechanical polishing pad of the present invention may be a multi-layered pad comprising a base layer on the non-polishing side of the pad.

The above base layer is a layer for supporting the polishing face of the chemical mechanical polishing pad on the rear side. Although the characteristic properties of this base layer are not particularly limited, it is preferably softer than the pad body. When the multi-layered polishing pad has a softer base layer, if the thickness of the pad body is small, for example, 1.0 mm or less, it is possible to prevent the pad body from rising and the surface of the polishing layer from curving during polishing, thereby making it possible to carry out polishing stably. The hardness of the base layer is preferably 90% or less, more preferably 50 to 90%, much more preferably 50 to 80%, particularly preferably 50 to 70% of the shore D hardness of the pad body.

The base layer may be made of a porous material (foam) or non-porous material. Further, the plane shape thereof is not particularly limited and may be the same or different from that of the polishing layer. This base layer may be, for example, circular or polygonal (such as tetragonal) shaped. The thickness of the base layer is not particularly limited but preferably 0.1 to 5 mm, more preferably 0.5 to 2 mm.

The material of the base layer is not particularly limited but preferably is an organic material because it is easily molded to have a predetermined shape and predetermined properties and can provide suitable elasticity.

The above chemical mechanical polishing pad of the present invention can provide a flat polished surfaces a high polishing rate and has sufficiently long service life.

The chemical mechanical polishing pad of the present invention can be set in a commercially available polishing machine to be used in the chemical mechanical polishing step in accordance with a known method.

When chemical mechanical polishing is carried out with the chemical mechanical polishing pad of the present invention, the surface to be polished can be prevented from being scratched and a polished surface having excellent flatness can be obtained.

EXAMPLES

Example 1

(1) Manufacture of Chemical Mechanical Polishing Pad (1-1) Preparation of Composition for Chemical Mechanical Polishing Pads 80 parts by volume (equivalent to 72.2 parts by weight) of 1,2-polybutadiene (JSR RB830 (trade name) of JSR Corporation) and 20 parts by volume (equivalent to 27.2 parts by weight) of β-cyclodextrin (Dexy Pearl β-100 (trade name) of Bio Research Corporation of Yokohama, average particle diameter of 20 μm) were kneaded together at 60 rpm by an extruder heated at 160° C. for 2 minutes. Thereafter, Percumyl D (trade name, manufactured by NOF Corporation, containing 40% by mass of decimal peroxide) was added in an amount of 0.722 parts by weight (equivalent to 0.4 parts by weight of decimal peroxide based on 100 parts by weight of 1,2-polybutadiene) and further kneaded at 60 rpm and 120° C. for 2 minutes to obtain a pellet of a composition for chemical mechanical polishing pads.

(1-2) Formation of Rough Shape of Pad

This pellet was heated at 170° C. for 18 minutes in a mold having a plaited projection portion (having a long diameter of 59 mm, a short diameter of 21 mm and a height of 0.6 mm, the center thereof was located at a position 100 mm away from the center of the rough shape of a circular pad and a straight line passing the center of the projecting portion and parallel to the long diameter side of the projecting portion is parallel to the direction of diameter of the rough shape of the circular pad) in part of the bottom force to be crosslinked so as to produce a disk-like molded product having a diameter of 600 mm and a thickness of 2.5 mm, part of the rear surface (non-polishing face) of which had been made thin. This thin portion corresponded to a light transmitting area for transmitting light for end-point detection when the chemical mechanical polishing pad was set in a chemical mechanical polishing machine equipped with an optical detector.

(1-3) Manufacture of Chemical Mechanical Polishing Pad

Then, concentric grooves (having a rectangular sectional form) having a width of 0.5 mm, a pitch of 2.0 mm and a depth of 1.0 mm were formed on the polishing side of this molded product by a commercially available cutting machine.

Further, concentric grooves (having a rectangular sectional form) having a width of 1.0 mm, a pitch of 2.0 mm and a depth of 0.5 mm were formed on the non-polishing side of this molded product by a commercially available cutting machine (no groove was formed at a position corresponding to the above light transmitting area). Further, a circular recessed portion having a diameter of 100 mm and a depth of 0.5 mm was formed at the center of the non-polishing face, a double-coated adhesive tape having the same plane shape as the pad was affixed to the non-polishing face, and a portion covering the thin portion (light transmitting area) for end-point detection of the double-coated adhesive tape was cut away.

FIG. 1 is a schematic diagram of the recessed portions formed on the non-polishing side.

(2) Evaluation of Chemical Mechanical Polishing Performance (2-1) Polishing of PETEOS Film Using an Aqueous Dispersion for Chemical Mechanical Polishing Containing Silica Abrasive Grains The above manufactured chemical mechanical polishing pad was fixed on the platen of a chemical mechanical polishing machine (EPO112 of Ebara Corporation) by bonding with an adhesive tape to carry out the chemical mechanical polishing of a 200 mm-diameter wafer having a non-patterned PETEOS film ($SiO_2$ film formed from tetraethyl orthosilicate by chemical vapor deposition using plasma as a promoter) on the surface under the following conditions.

Aqueous Dispersion for Chemical Mechanical Polishing

CMS-1101 (trade name, manufactured by JSR Corporation, containing silica abrasive grains) diluted with ion exchange water to 3 times Feed rate of aqueous dispersion: 200 ml/min Revolution of platen: 70 rpm Revolution of head: 63 rpm Pressure of head: 4 psi Polishing time: 2 minutes In the above chemical mechanical polishing, the polishing rate was 200 nm/min, the in-plane uniformity was 1.2%, and the number of scratches on the entire surface of the wafer was 3.

The above polishing rate, in-plane uniformity and the number of scratches were measured as follows.

The film thickness before and after polishing was measured at 49 points in a direction of the diameter at intervals of 3.75 mm from a point 10 mm inward from the end of the wafer with an optical thickness measurement system, the average value of film thickness differences before and after polishing at the 49 points was taken as polishing rate, and the in-plane uniformity was calculated from the differences in film thickness at the 49 points based on the following equation.

In-plane uniformity=(standard deviation of difference in film thickness)÷(average value of differences in film thickness)×100(%)

The total number of scratches formed on the entire polished surface of the wafer was counted with a wafer defect inspection device (KLA2351 of KLA-Tencor Co., Ltd.).

(2-2) Polishing of PETEOS Film using an Aqueous Dispersion for Chemical Mechanical Polishing Containing Ceria Abrasive Grains A chemical mechanical polishing pad manufactured in the same manner as in (1) was fixed on the platen of a chemical mechanical polishing machine (EPO112 of Ebara Corporation) by bonding with an adhesive tape to carry out the chemical mechanical polishing of a 200 mm-diameter wafer having a non-patterned PETEOS film on the surface under the following conditions.

Aqueous Dispersion for Chemical Mechanical Polishing
aqueous dispersion containing ceria and ammonium salt of polycyclic acid, each in an amount of 1% by mass
Feed rate of aqueous dispersion: 150 ml/min
Revolution of platen: 50 rpm
Revolution of head: 70 rpm
Pressure of head: 3 psi
Polishing time: 1 minute In the above chemical mechanical polishing, when the polishing rate, in-plane uniformity and the number of scratches on the entire surface of the wafer were measured in the same manner as in (2-1), they were 170 nm/min, 1.4% and 2, respectively.

(2-3) Polishing of a Wafer having the Pattern of Copper and Low-dielectric Insulating Films A 508 mm-diameter piece cut out along concentric grooves of a chemical mechanical polishing pad manufactured in the same manner as in (1) was fixed on the platen of a chemical mechanical polishing machine equipped with an optical end-point detector (Mirra/Mesa of Applied Materials Co., Ltd.) by bonding with an adhesive tape to carry out the chemical mechanical polishing of Sematech800BDM001 (trade name, manufactured by International SEMATECH Co., Ltd., test wafer consisting of a silicon substrate, a silicon carbide layer on the silicon substrate, a layer of the Black Diamond low-dielectric insulating film (trade name, manufactured by Applied Materials Co., Ltd.) in portions other than wiring portions on the silicon carbide layer, tantalum layer as a barrier metal and copper layer as a wiring material on the layer in the mentioned order) as an object to be polished in two stages under the following conditions.

The first-stage polishing time was calculated by multiplying the time from the start of polishing to the time when reflectance changed (that is, the point of time when the barrier metal was exposed) by 1.2 by monitoring the reflectance of a laser beam with the optical end-point detector of the chemical mechanical polishing machine.

Conditions of First-stage Polishing

Aqueous Dispersion for Chemical Mechanical Polishing
mixture of ice 5003 (trade name, manufactured by Cabot Microelectronics Co., Ltd., containing silica abrasive grains) and a 30% by mass of hydrogen peroxide solution in a volume ratio of 11:1
Feed rate of aqueous dispersion: 300 ml/min
Revolution of platen: 120 rpm
Revolution of head: 35 rpm
Pressure of head:
Retainer ring pressure: 5.5 psi
Membrane pressure: 3.0 psi
Inner tube pressure: 0.0 psi Conditions of Second-stage Polishing Aqueous Dispersion for Chemical Mechanical Polishing
mixture of CMS-8301 (trade name, manufactured by JSR Corporation) and 1% by mass of a solution containing 30% by mass of hydrogen peroxide
Feed rate of aqueous dispersion: 200 ml/min
Revolution of platen: 60 rpm
Revolution of head: 54 rpm
Pressure of head:
Retainer ring pressure: 5.5 psi
Membrane pressure: 3.0 psi
Inner tube pressure: 0.0 psi
Polishing time: 100 seconds When the total number of scratches on the entire polished surface of the wafer were counted with a wafer defect inspection device (KLA2351 of KLA-Tencor Co. Ltd.), there were 7 scratches on the copper wiring and 3 scratches on the low-dielectric insulating film.

Example 2

A chemical mechanical polishing pad was manufactured in the same manner as in (1) manufacture of chemical mechanical polishing pad of Example 1 and a base layer made of foamed polyurethane having the same plane shape and the same thickness as that of the polishing pad was fixed on the non-polishing side (rear surface) by a double-coated adhesive tape having the same plane shape as the polishing pad. Further, a double-coated adhesive tape having the same plane shape as the polishing pad was affixed to the rear surface of the base layer. Then, portions covering the light transmitting area of the pad of the double-coated adhesive tape affixed to the rear surface of the pad, the base layer and the double-coated adhesive tape affixed to the rear surface of the base layer were cut away to manufacture a chemical mechanical polishing pad comprising the base layer.

The chemical mechanical polishing performance was evaluated in the same manner as in Example 1 except that the manufactured chemical mechanical polishing pad comprising the base layer was used. The results are shown in Table 1.

Example 3

A pellet of a composition for chemical mechanical polishing pads was obtained in the same manner as in (1-1) preparation of composition for chemical mechanical polishing pads of Example 1.

This pellet was heated in a mold having a plaited projection portion and a large number of columnar projection portions in part of the bottom force at 170° C. for 18 minutes to be crosslinked so as to produce a disk-like molded product having a diameter of 600 mm and a thickness of 2.5 mm. The above plaited projection portion had a long diameter of 59 mm, a short diameter of 21 mm and a height of 0.6 mm, the center thereof was located at a position 100 mm away from the center of the rough shape of a circular pad, and a straight line passing the center of the projection portion and parallel to the long diameter side was parallel to the direction of diameter of the rough shape of the circular pad. The above large number of columnar projection portions had a diameter of 5 mm and a height of 1.0 mm and were located at respective intersecting points of a lattice having a pitch of 10 mm in an area (excluding a portion corresponding to the above plaited projection portion) having a radius of 250 mm from the center of the pad. Recessed portions corresponding to the above projection portions were formed on the rear surface of the obtained disk-like molded product. Out of these recessed portions, the recessed portion formed by the plaited projection portion corresponded to the light transmitting area for transmitting light for end-point detection when the chemical mechanical polishing pad was set in a chemical mechanical polishing machine equipped with an optical detector.

Concentric grooves (having a rectangular sectional form) having a width of 0.5 mm, a pitch of 2.0 mm and a depth of 1.0 mm were formed in the polishing face of the above molded product by a commercially available cutting machine.

Thereafter, a double-coated adhesive tape having the same plane shape as the pad was affixed to the non-polishing side and a portion covering the thin portion for end-point detection (light transmitting area) of the double-coated adhesive tape was cut away.

Figure 2:
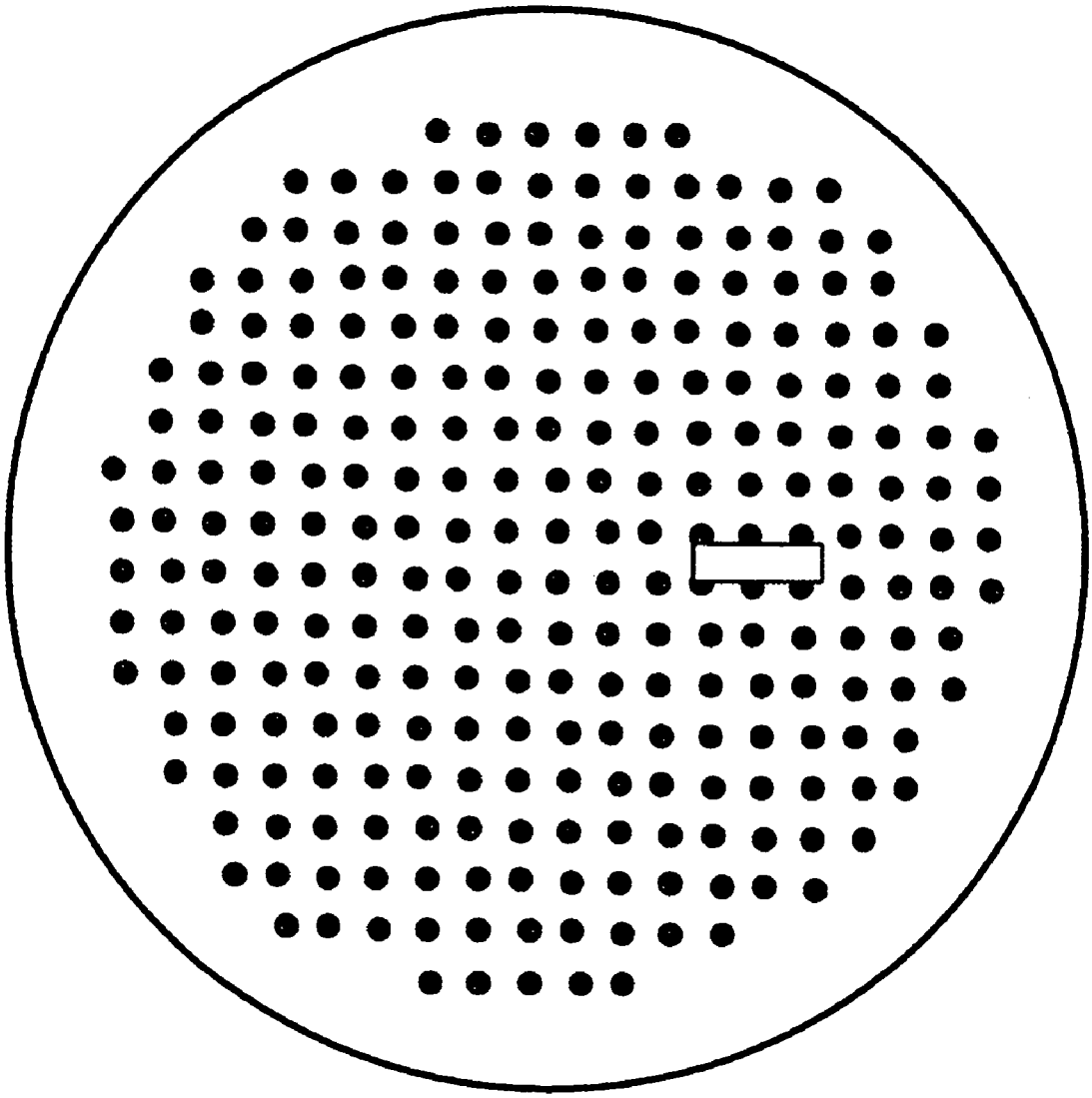
FIG. 2 is a schematic diagram of the recessed portions of the rear surface of a chemical mechanical polishing pad manufactured in Example 3.

FIG. 2 is a schematic diagram of the recessed portions formed on the non-polishing side.

The chemical mechanical polishing performance was evaluated in the same manner as in Example 1 except that the thus manufactured chemical mechanical polishing pad was used. The results are shown in Table 1.

Example 4

A disk-like molded product was obtained in the same manner as in (1-1) preparation of composition for chemical mechanical polishing pads and (1-2) formation of rough shape of pad of Example 1.

Concentric grooves (having a rectangular sectional form) having a width of 0.5 mm, a pitch of 2.0 mm and a depth of 1.0 mm were formed on the polishing side of the above molded product by a commercially available cutting machine. Lattice grooves (having a rectangular sectional form) having a width of 1.0 mm, a depth of 0.5 mm and a pitch of 20 mm were formed in an area (excluding a portion corresponding to the light transmitting area) having a radius of 250 mm from the center of the pad of the non-polishing side of the molded product.

Thereafter, a double-coated adhesive tape having the same plane shape as the pad was affixed to the non-polishing side and a portion covering the thin portion for end-point detection (light transmitting area) of the double-coated adhesive tape was cut away.

Figure 3:
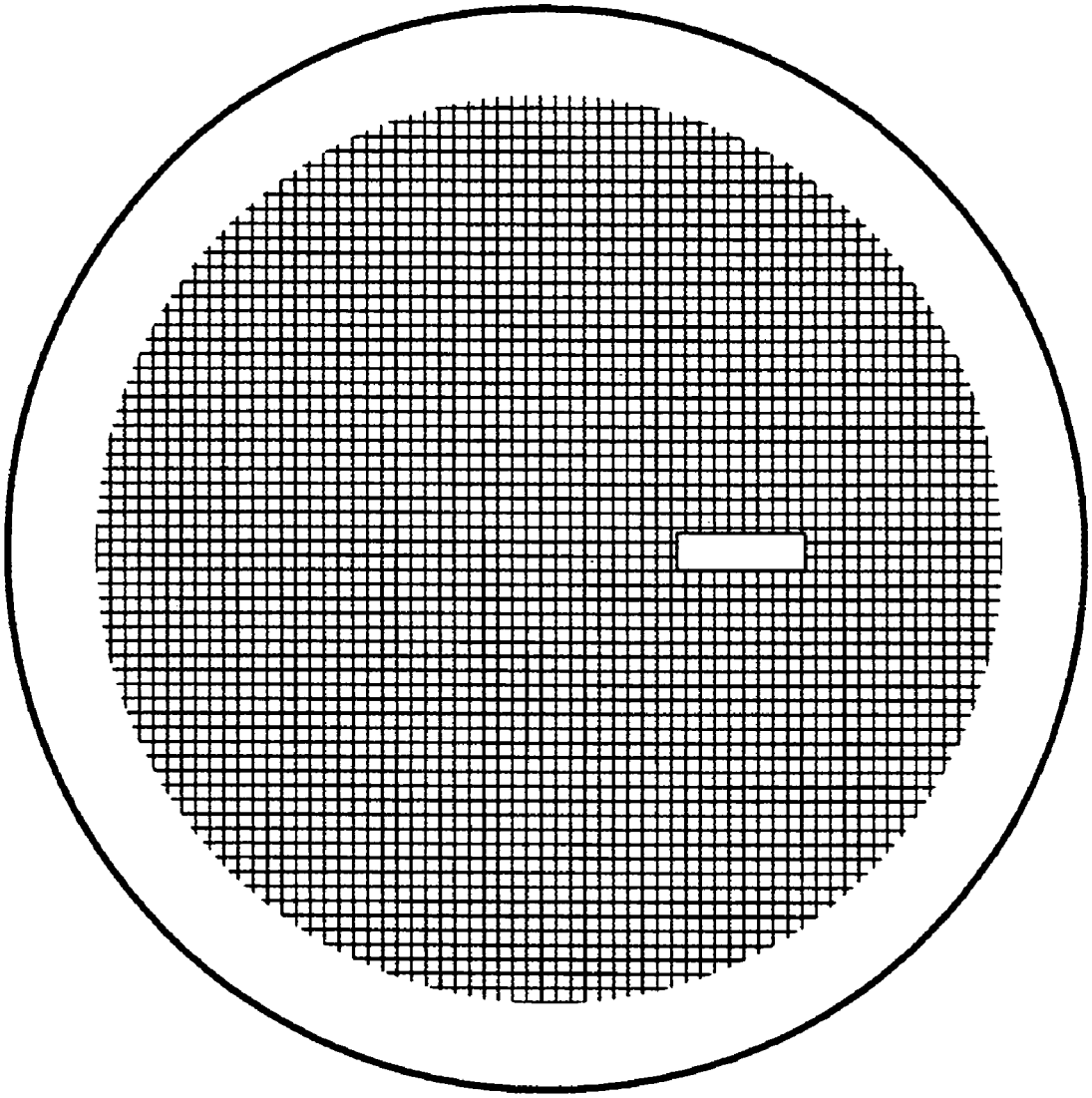
FIG. 3 is a schematic diagram of the recessed portions of the rear surface of a chemical mechanical polishing pad manufactured in Example 4.

FIG. 3 is a schematic diagram of the recessed portions formed on the non-polishing side.

The chemical mechanical polishing performance was evaluated in the same manner as in Example 1 except that the thus manufactured chemical mechanical polishing pad was used. The results are shown in Table 1.

Example 5

The double-coated adhesive tape on the non-polishing side (rear surface) of the IC1000 chemical mechanical polishing pad (consisting of a single layer) of Rohm and Haas Electronics, Materials Co., Ltd. was removed and concentric grooves (having a rectangular sectional form) having a width of 1.0 mm, a pitch of 2.0 mm and a depth of 0.5 mm were formed on the non-polishing side (rear surface) by a commercially available cutting machine. Thereafter, a double-coated adhesive tape having the same plane shape as the pad was affixed to the non-polishing side.

The chemical mechanical polishing performance was evaluated in the same manner as in Example 1 except that the thus manufactured chemical mechanical polishing pad was used. Since the obtained chemical mechanical polishing pad had no light transmitting portion for transmitting detection light from the optical end-point detector, the first-stage polishing in (2-3) polishing of a wafer having the pattern of copper and low-dielectric insulating films was carried out for 120 seconds without using the optical end-point detector.

The results are shown in Table 1.

Comparative Example 1

A disk-like molded product was obtained by carrying in the same manners as in (1-1) preparation of composition for chemical mechanical polishing pads and (1-2) formation of rough shape of pad of Example 1.

Then, concentric grooves (having a rectangular sectional form) having a width of 0.5 mm, a pitch of 2.0 mm and a depth of 1.0 mm were formed on the polishing side of the above molded product by a commercially available cutting machine. Thereafter, a double-coated adhesive tape having the same plane shape as the pad was affixed to the non-polishing side and a portion covering the thin portion for end-point detection (light transmitting area) of the double-coated adhesive tape was cut away to manufacture a chemical mechanical polishing pad having no recessed portion on the non-polishing side.

The chemical mechanical polishing performance was evaluated in the same manner as in Example 1 except that the thus manufactured chemical mechanical polishing pad was used. The results are shown in Table 1.

Comparative Example 2

A disk-like molded product was obtained by carrying in the same manners as in (1-1) preparation of composition for chemical mechanical polishing pads and (1-2) formation of rough shape of pad of Example 1.

Then, concentric grooves (having a rectangular sectional form) having a width of 0.5 mm, a pitch of 2.0 mm and a depth of 1.0 mm were formed on the polishing side of the above molded product by a commercially available cutting machine. Lattice grooves (having a rectangular sectional form) having a width of 1.0 mm, a depth of 0.5 mm and a pitch of 20 mm were formed on the entire non-polishing side (excluding a portion corresponding to a light transmitting area) of this molded product. The formed lattice grooves reached the end of the pad. Thereafter, a double-coated adhesive tape having the same plane shape as the pad was affixed to the non-polishing side and a portion covering the thin portion for end-point detection (light transmitting area) of the double-coated adhesive tape was cut away.

Figure 4:
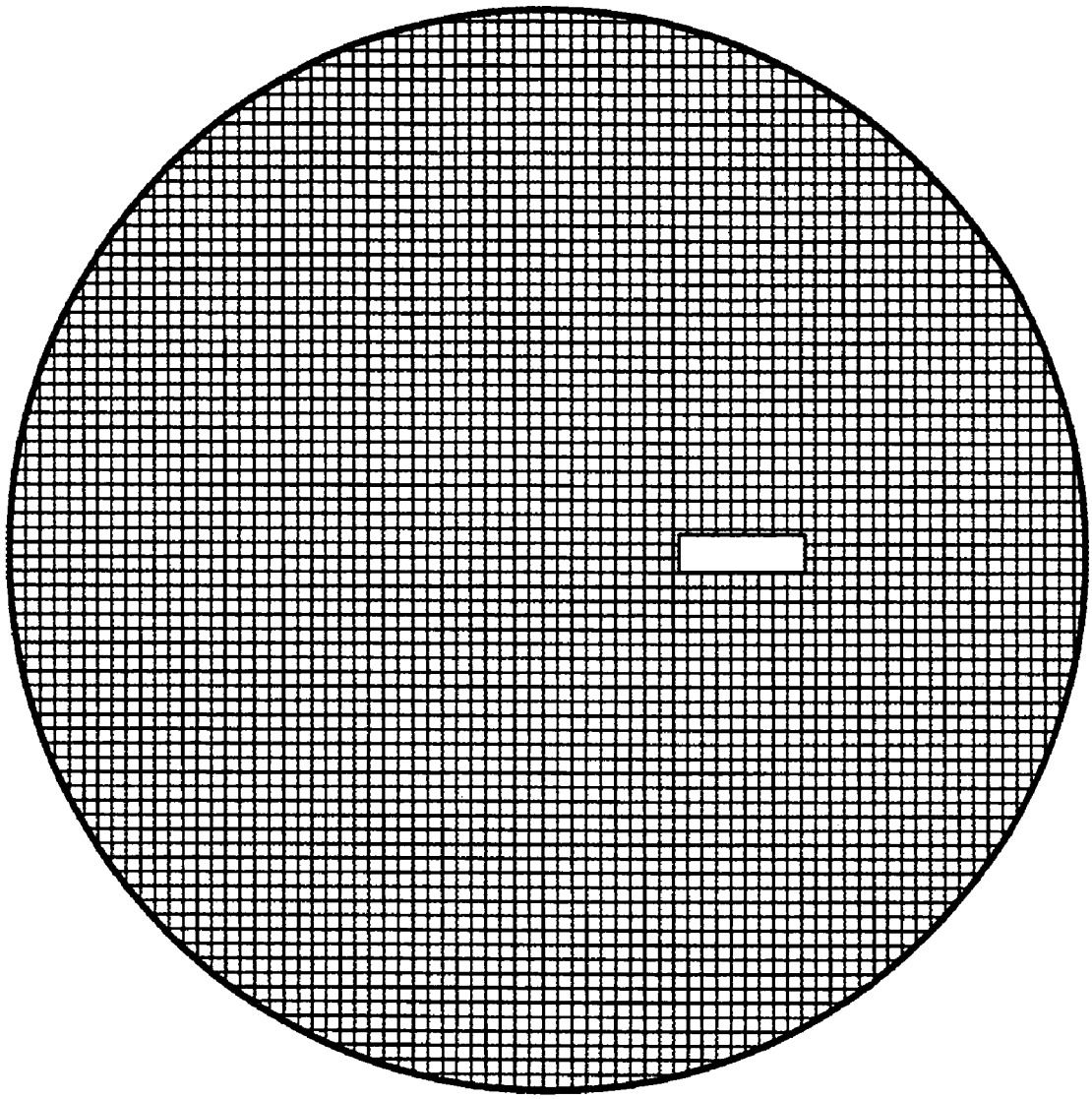
FIG. 4 a schematic diagram of the recessed portions of the rear surface of a chemical mechanical polishing pad manufactured in Comparative Example 2.

FIG. 4 is a schematic diagram of the recessed portions formed on the non-polishing side.

The chemical mechanical polishing performance was evaluated in the same manner as in Example 1 except that the thus manufactured chemical mechanical polishing pad was used. The results are shown in Table 1.

Comparative Example 3

The chemical mechanical polishing performance was evaluated in the same manner as in Example 1 except that the IC1000 chemical mechanical polishing pad of Rohm and Haas Electronic Materials Co., Ltd. (consisting of a single layer) was used. Since this chemical mechanical polishing pad had no light transmitting portion for transmitting detection light from the optical end-point detector, the first-stage polishing in (2-3) polishing of a wafer having the pattern of copper and a low-dielectric insulating films was carried out for 120 seconds without using the optical end-point detector. The results are shown in Table 1.

TABLE 1

| | Polishing of PETEOS film by silica | | | polishing of PETEOS film by ceria | | | polishing of a patterned wafer | | |
|---|---|---|---|---|---|---|---|---|---|
| | | | | | | | First-stage | number of scratches | |
| | Polishing rate (nm/min) | in-plane uniformity (%) | number of scratches | Polishing rate (nm/min) | in-plane uniformity (%) | number of scratches | polishing time (seconds) | on copper wiring | on insulating film |
| Ex. 1 | 200 | 1.2 | 3 | 170 | 1.4 | 2 | 120 | 7 | 3 |
| Ex. 2 | 200 | 1.3 | 2 | 160 | 1.5 | 2 | 118 | 6 | 5 |
| Ex. 3 | 210 | 1.2 | 3 | 170 | 1.3 | 3 | 117 | 9 | 4 |
| Ex. 4 | 210 | 1.4 | 4 | 170 | 1.5 | 2 | 120 | 7 | 4 |
| Ex. 5 | 190 | 1.4 | 5 | 180 | 1.7 | 5 | 120 | 10 | 6 |
| C. Ex. 1 | 200 | 1.9 | 15 | 170 | 1.6 | 18 | 123 | 55 | 23 |
| C. Ex. 2 | 210 | 2.1 | 3 | 170 | 2.3 | 4 | 118 | 9 | 4 |
| C. Ex. 3 | 190 | 2.0 | 21 | 180 | 2.2 | 16 | 120 | 71 | 40 |

Ex.: Example
C. Ex.: Comparative Example

What is claimed is:

1. A chemical mechanical polishing pad having a face for polishing an object to be polished, a non-polishing face opposite to the polishing face and a side face for interconnecting said polishing and non-polishing faces and including a pattern of first recessed portions which are formed on the non-polishing face, are open to the non-polishing face and are located exclusive of the side face, and which further comprises a circular or polygonal recessed portion, which does not form the pattern, in a center portion of said non-polishing face wherein a double-coated adhesive tape is affixed to said non-polishing face thereby to form closed spaces of said first recess portions between said double-coated adhesive tape and said non-polishing face and wherein said first recessed portions do not extend to said polishing face.

2. The chemical mechanical polishing pad according to claim 1, wherein the recessed portions forming the pattern on the non-polishing face comprise one of circular, elliptic, polygonal and groove-like recessed portions.

3. The chemical mechanical polishing pad according to claim 1 wherein the non-polishing area has an area having substantially high light transmission properties in a portion other than the center portion of the non-polishing face.

4. The chemical mechanical polishing pad according to claim 3, wherein the area having a substantially high light transmission properties comprises a recessed portion formed in a portion spaced from the center portion of the non-polishing face.

5. The chemical mechanical polishing pad according to claim 1 wherein the pad comprises a material having a water-insoluble material and water-soluble particles dispersed in the water-insoluble material.

6. The chemical mechanical polishing pad according to claim 1 wherein the recessed portion in a center portion of said non-polishing face is circular.

7. The chemical mechanical polishing pad according to claim 6 wherein the recessed portion has a diameter which is 100% or less than a diameter of the object to be polished.

8. A chemical mechanical polishing pad having a face for polishing an object to be polished, a non-polishing face opposite to the face and a side face for interconnecting said polishing and non-polishing faces and including a pattern of first recessed portions which are formed on the non-polishing face, are open to the non-polishing face and are located exclusive of the side face, and which further comprises a circular or polygonal recessed portion, which does not form the pattern, in a center portion of said non-polishing face wherein a base layer is affixed to said non-polishing face thereby to form closed spaces of said first recess portions between said base and said non-polishing face and wherein said first recessed portions do not extend to said polishing face.

* * * * *